United States Patent [19]

Perrella

[11] 4,423,763

[45] Jan. 3, 1984

[54] COMPACT INJECTION ASSEMBLY FOR DIE CASTING MACHINES

[75] Inventor: Guido Perrella, Senneville, Canada

[73] Assignee: DBM Industries Limited, Quebec, Canada

[21] Appl. No.: 258,814

[22] Filed: Apr. 29, 1981

[30] Foreign Application Priority Data

Jan. 20, 1981 [CA] Canada ..... 368889

[51] Int. Cl.[3] ..... B22D 17/04; B29F 1/00

[52] U.S. Cl. ..... 164/316; 425/542

[58] Field of Search ..... 164/309, 310, 311, 316, 164/317, 318; 425/542, 549, 550, 551, 567, 574

[56] References Cited

U.S. PATENT DOCUMENTS 2,145,448 1/1939 Lester ..... 164/318

3,234,605 2/1966 Thompson ..... 164/318

4,261,414 4/1981 Frenette et al. ..... 164/316

*Primary Examiner*—Gus T. Hampilos

*Assistant Examiner*—Peter B. Martine

*Attorney, Agent, or Firm*—Beveridge, DeGrandi & Kline

[57] ABSTRACT

A compact injection assembly for die casting machines is disclosed. The assembly includes a small reservoir or pot for retaining a molten casting metal delivered thereto from a remote source. The assembly includes a cylinder with a piston and shot chamber therein, a nozzle and interconnecting conduit to the shot chamber. The assembly is supported by a single swivel socket arrangement directly below the shot chamber and cylinder. Horizontal outrigger arms are utilized to orient the assembly in its proper vertical position.

3 Claims, 6 Drawing Figures

COMPACT INJECTION ASSEMBLY FOR DIE CASTING MACHINES

This invention relates to die casting machines and in particular to injection systems thereof.

BACKGROUND OF THE INVENTION

Any injection systems of conventional die casting machines, the casting metal such as zinc usually has a long and sometimes tortuous path to travel from the zinc reservoir to the cavity of the die. This path extends through the neck of the gooseneck; the nozzle which is usually perpendicularly mounted to the surface of the die; through a spreader in the center of the die and the runners which run perpendicular to the spreader.

In addition, high injection pressures and velocity of metal is required to ensure that the casting metal reaches the intricacies of the cavities in the dies before solidification takes place. One of the reasons for this is that the molten casting metal is positioned at some distance from the die cavity.

Furthermore, because of the high injection pressures and velocity of metal that is required in conventional systems, a high kinetic energy is created by the mass of molten casting metal during the injection or shot and this causes the dies to blow apart with resulting flashes of zinc in certain areas.

Because of the aforementioned long path travelled by the zinc from the furnace reservoir to the cavity, substantial porosity in the casting is caused by air being compressed along the path of travel and mixed with the molten zinc. This is referred to as the "bicycle pump effect". Therefore, in conventional systems there is difficulty in achieving good, porous free castings. The production of quality thin wall castings having a good surface finish is also difficult because of these problems mentioned above.

The present invention provides substantial improvements over the conventional systems by providing a compact injection assembly which can be mounted in close proximity to the die, as close as possible to the die itself.

Additionally, the path the zinc takes in the use of the present invention is substantially straight and because of its close proximity to the point of entrance of the die, the injection pressure and velocity of molten metal is substantially reduced.

Those skilled in the art will appreciate that, in order to reduce the kinetic energy, the movement of the mass of zinc during injection has to be the smallest possible and as close as possible to the die. In the present invention, the zinc can be less than two inches away from the point of entrance of the die and the plunger centre line is only inches away from the die centre line.

As the assembly of the present invention moves the zinc very close to the point of entrance of the die, the amount of air compressed into the die cavity is greatly reduced. Therefore, the "bicycle pump effect" mentioned above is substantially less than in a conventional die casting machine and there is a noticeable reduction in the amount of porosity in the product. Furthermore, with the zinc being close to the die it reaches the cavities in the dies in a shorter period of time and with less temperature drop and thin wall castings and good surface finish castings are more readily produced in accordance with the injection assembly of the present invention due to the short path of the zinc and the short injection time achieved without high injection pressures.

The invention is illustrated by way of example in the accompanying drawings in which.

Figure 1:
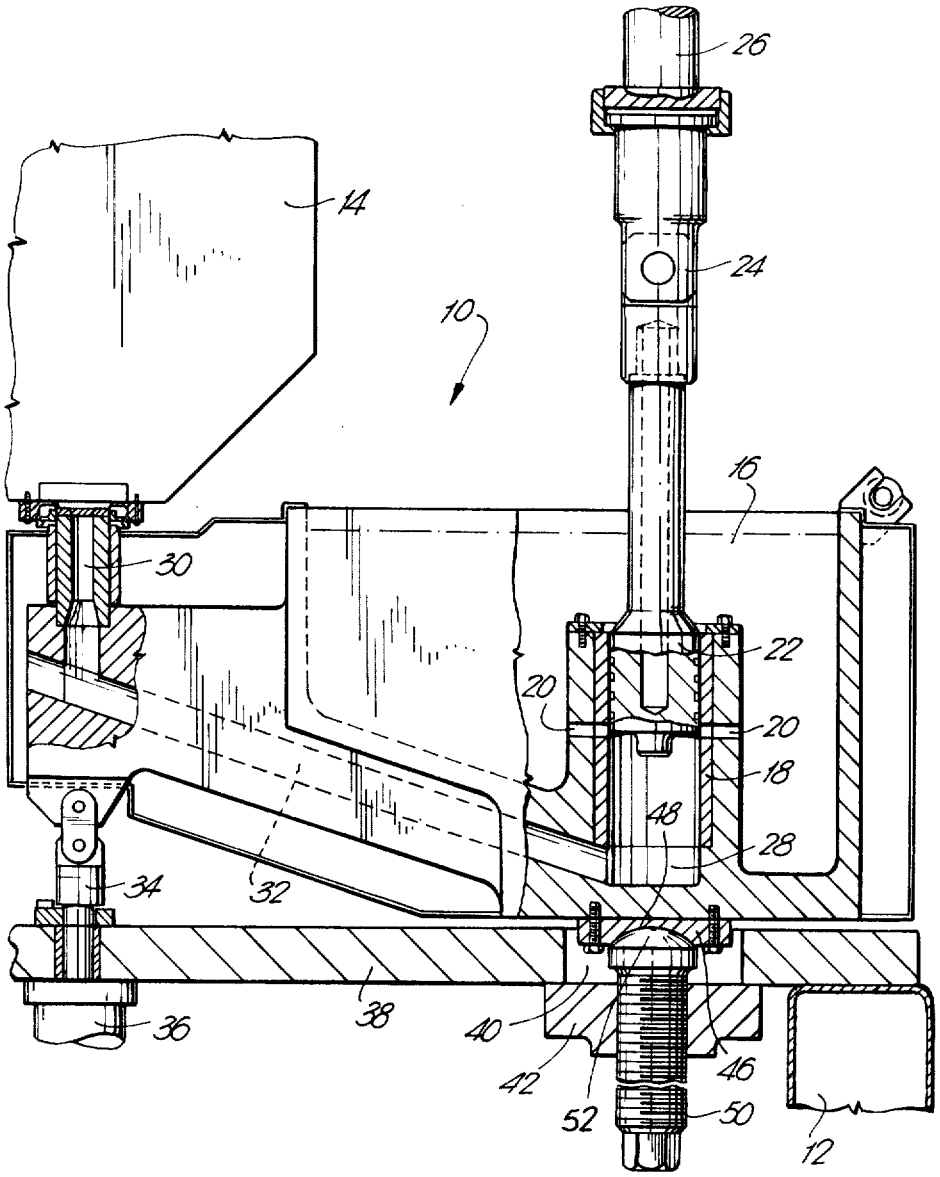
FIG. 1 is an elevation view partly in section of one embodiment of the injection assembly.

Referring to FIG. 1, the injection assembly illustrated generally at 10 is adapted for mounting on to the frame 12 of a die casting machine, the die carriers 14 of which are partially indicated. The assembly 10 is of compact design and includes a very small and narrow container or pot 16 for retaining a casting metal such as zinc delivered thereto from a remotely positioned central furnace such as by pump means. The pot 16 is provided with a cylinder 18 having inlets 20 so that the cylinder can communicate with the interior of the pot 16. A piston 22 is mounted for vertical reciprocal movement in the cylinder 18 and its upper end is connected as at 24 to a suitable actuator rod 26 of a known form of driving means for the piston such as an accumulator, not illustrated.

The lower end of the cylinder 18 is provided with a shot chamber 28 which is connected to a nozzle 30 by means of a very direct delivery conduit 32.

In the embodiment illustrated in FIG. 1, the nozzle end of the pot 16 is supported somewhat resiliently by the piston end 34 of a hydraulic shock absorber 36.

Figure 2:
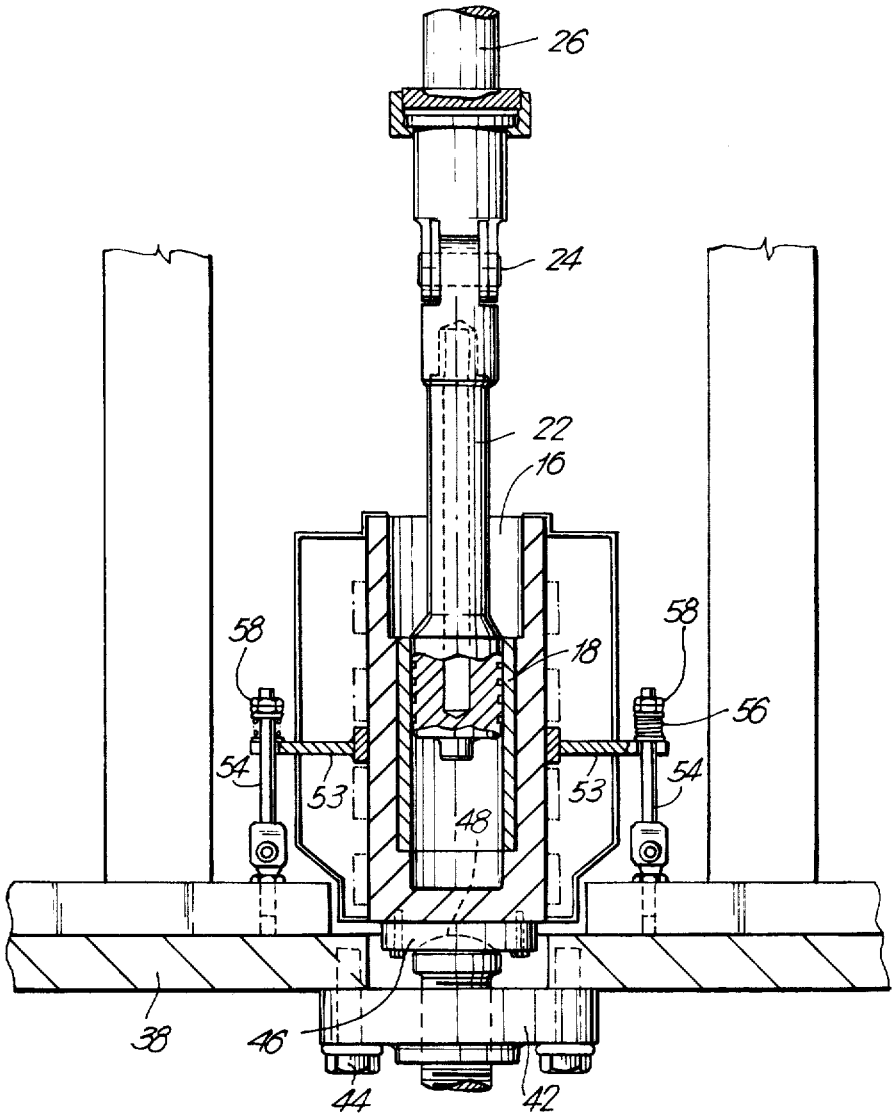
FIG. 2 is an end view of the assembly shown in FIG. 1.

The complete assembly is supported at a single point directly below the shot chamber 28. As illustrated, the frame of the die casting machine is provided with a supporting plate 38 having an aperture 40 therein, this aperture being bridged by a collar 42 of substantial strength and secured to the support plate 38 by suitable cap screws 44. The lower end of the pot 16 is provided with a plate 46 having a concave surface 48. A large threaded bolt 50 is positioned in the collar 42, the upper end of bolt 50 having a spherical head 52 for reception in the concave surface 48 of the plate 46 as shown in FIG. 1. With this support means, the latter takes the full thrust of the piston 22 during an injection stroke. Vertical orientation of the injection assembly relative to the die assembly 14 is made by horizontal arms 53 extending outwardly of the pot 16, the arms serving as upper mounting points for hold-down bolts 54 connected at their lower ends to the plate 38, their upper ends passing through apertures in the arms 53 and being secured thereto by springs 56 under nuts 58. See FIG. 2.

Figure 3:
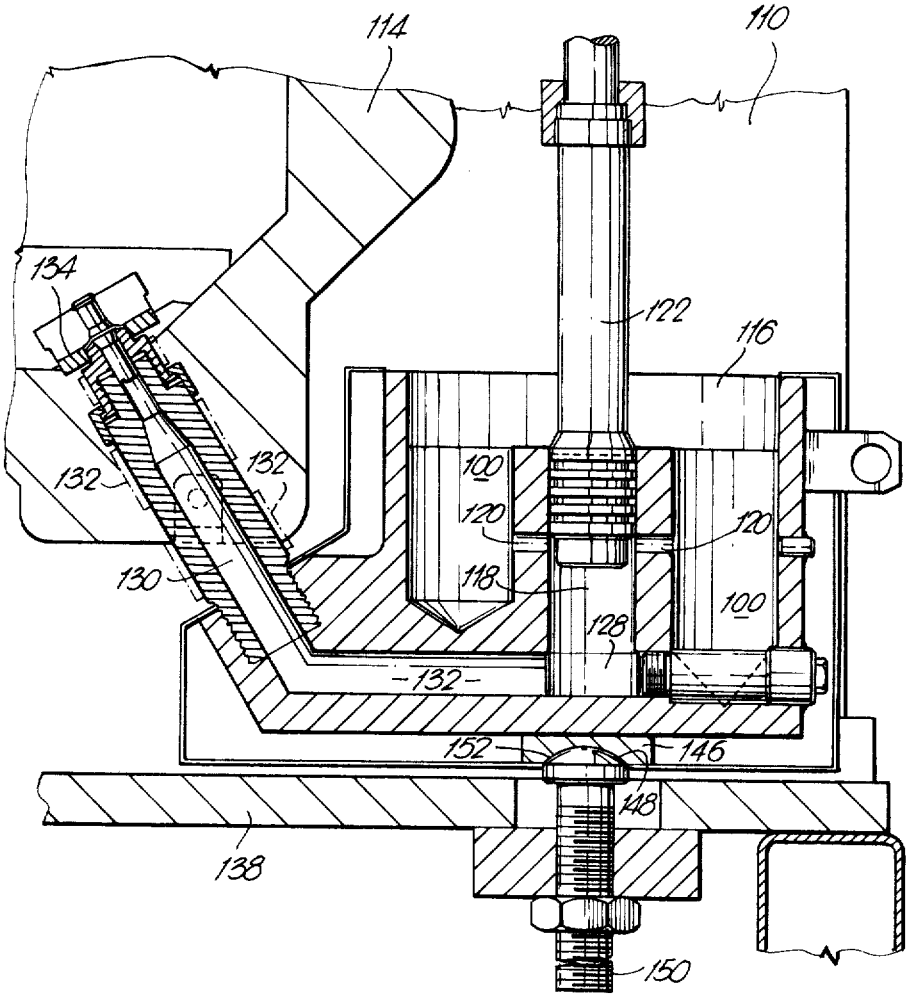
FIG. 3 is an elevation view, partly in section, of another embodiment of the invention.
Figure 4:
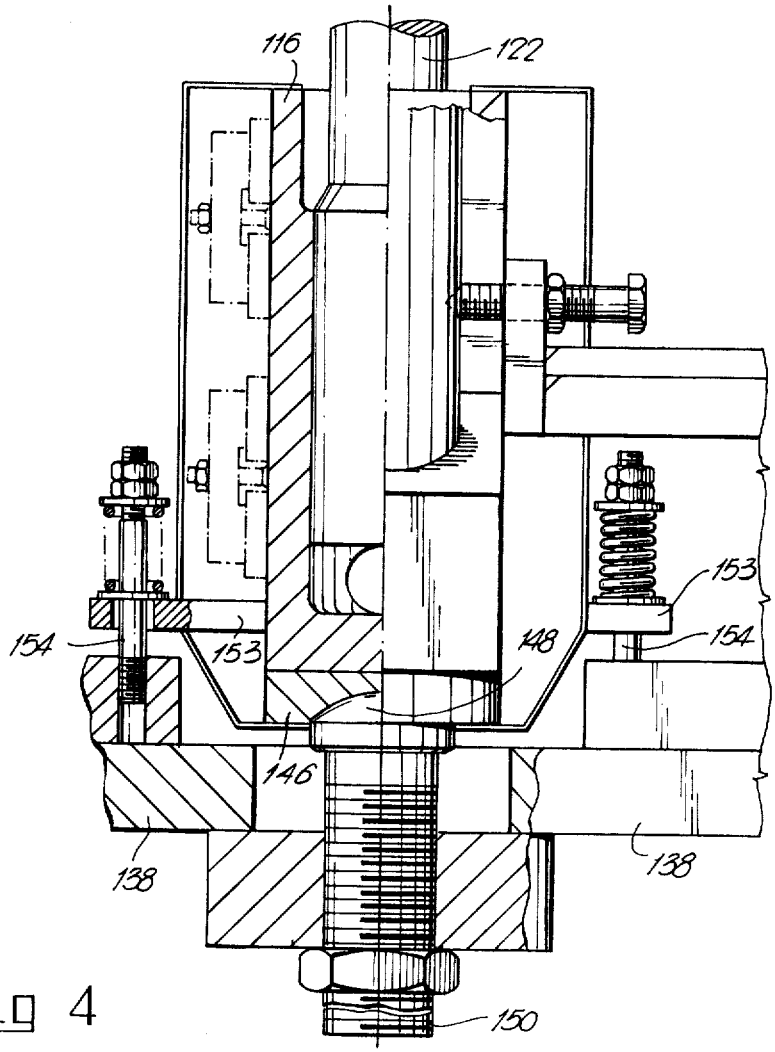
FIG. 4 is an end view partly in section of the assembly shown in FIG. 3.

The embodiment of the invention shown in FIGS. 3 and 4 is quite similar to that described above but the pot 116 is designed in such a way that the assembly can get closer still to the die assembly 114 as shown. In the embodiment of FIG. 3, the pot 116 has its delivery conduit 132 extending horizontally from the shot chamber 128 until it reaches the lower end of the nozzle 130.

Passageways 120 interconnect the cylinder 118 with reservoirs 100 of the pot, the lower end of the assembly again being supported by a ball and socket arrangement utilizing the spherical head 152 of a bolt 150 in cooperation with the concave seat 148 in a plate 146 on the lower end of the assembly 110.

As in the previous embodiment, the vertical orientation of the pot 116 relative to the die assembly 114 is attained through the use of resiliently mounted hold-down bolts 154 interconnecting horizontal arms 153 to the support plate 138 of a die casting machine in which the injection assembly is mounted.

Figure 5:
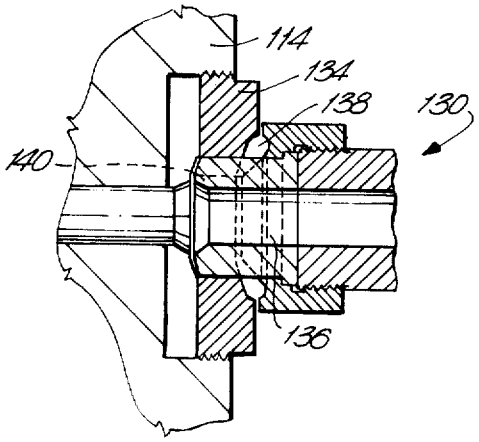
FIG. 5 is a cross-sectional view taken through a preferred form of nozzle for the present invention.

FIG. 5 shows a preferred configuration for the nozzle 130 which, as shown in FIG. 3, may have a series of band heaters 132 thereon. The nozzle 130 has a square insert 134 for insertion into the dies 114 so that when the dies come together the square or diamond shaped inserts 134 will trap and contain the nozzle tip 136. It will be noted that the nozzle configuration includes a flash guard 138 which communicates with the nozzle tip through a passageway 140.

Figure 6:
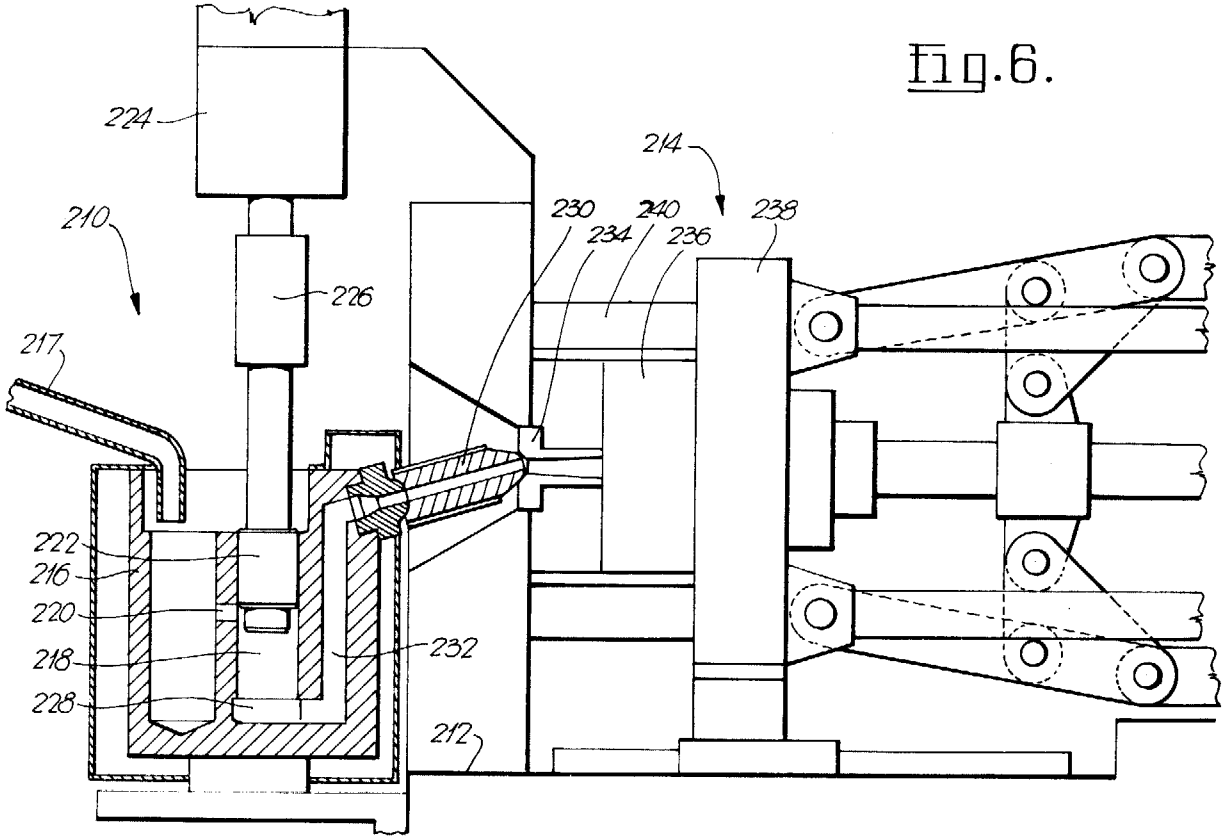
FIG. 6 is a partially cross-sectional, elevation view of another embodiment of the invention.

FIG. 6 is an elevation view partly in section, of the injection assembly of the present invention as used with a conventional die casting machine. The assembly indicated generally at 210 is shown mounted on the frame 212 of a conventional die casting machine 214. The assembly 210 includes the small, compact container or pot 216 to which a casting metal such as zinc is delivered thereto from a remotely positioned central furnace, not shown, through a suitable supply duct 217. The pot 216 includes a cylinder 218 with an inlet 220 allowing the cylinder to communicate with the reservoir 216. The piston 222 is mounted in the cylinder 218 for vertical reciprocation therein, the upper end being connected to a suitable shot cylinder 224 through a connector 226. The lower end of cylinder 218 has a shot chamber 228 interconnected to a nozzle 230 through a short, very direct delivery conduit 232. Nozzle 230 engages a nozzle extension 234 for transmitting the molten zinc into a cavity of the stationary die 236 and movable die carried in the platen 238. The platen is reciprocated into closing and opening relation with the fixed die 236 along tie bars or beams 240 in the conventional manner.

It will be appreciated by those skilled in the art that the injection assembly of this invention can be used in any existing die casting machine to great advantage. The assembly provides noticeably improved results in castings whether the assembly is mounted on a conventional, fixed platen machine or whether it is used in a machine having two moving platens.

While the present invention has been described in connection with specific embodiments thereof, various modifications will occur to those skilled in the art without departing from the spirit and scope of this invention as set forth in the attached claims.

The terms and expressions which have been employed in this disclosure are used as terms of description and not of limitation and there is no intention in the use of such terms and expressions to exclude any equivalents of the features shown and described or portions thereof. It is recognized, however, that various modifications are possible within the scope of the invention claimed.

The embodiments of the invention in which an exclusive property or privilege is claimed are defined as follows:

1. A compact injection assembly for die casting machines, said compact assembly including a small pot for retaining a molten casting metal therein and delivered thereto from a remote source; a cylinder having upper and lower ends integrally formed in said pot and a piston mounted for reciprocation therein, a shot chamber in the lower end of the cylinder, a nozzle and a passageway interconnecting the shot chamber and nozzle; and means connectable to said die casting machine for supporting said assembly at a single point in close proximity to the dies of said machine, said single point of support comprising a vertically adjustable bolt having a spherical head thereon and a socket member on said assembly directly below said cylinder for receiving said spherical head; the highest level of casting metal in said pot being lower than the runner of a casting formed in said machine.

2. The assembly according to claim 1 including means for adjusting the vertical orientation of the injection assembly relative to an associated die assembly comprising arms extending horizontally of said assembly and hold-down bolts combined with spring means for resiliently applying downward pressure on said arms through connections to said die casting machine.

3. A compact injection assembly according to claim 1 including additional means for supporting said assembly directly below said nozzle.

* * * * *